US005829677A

United States Patent [19]

Moses

[11] Patent Number: 5,829,677

[45] Date of Patent: Nov. 3, 1998

[54] WATER HEATING AND COOLING SYSTEM HAVING A DUAL WATER MIXING AND AIR SEPARATOR APPARATUS

[75] Inventor: Terrence J. Moses, Cincinnati, Ohio

[73] Assignee: Systecon, Inc., Wester Chester, Ohio

[21] Appl. No.: 929,449

[22] Filed: Sep. 15, 1997

Related U.S. Application Data

[63] Continuation of Ser. No. 695,659, Aug. 12, 1996, Pat. No. 5,738,277.

[51] Int. Cl.[6] ..... F24D 3/10

[52] U.S. Cl. ..... 237/66; 237/56; 137/896

[58] Field of Search ..... 237/66, 56; 137/896

[56] References Cited

U.S. PATENT DOCUMENTS 5,316,384 5/1994 Corso .

5,425,503 6/1995 Corso .

*Primary Examiner*—Henry A. Bennett
*Assistant Examiner*—Derek S. Boles
*Attorney, Agent, or Firm*—Francis T. Kremblas, Jr.

[57] ABSTRACT

An improved closed loop variable volume water heating or cooling system having one or more work units for supplying heated or cooling water to a heating or cooling system which includes a dual purpose water mixing and air separator vessel. This vessel includes two inlets and one outlet port disposed in predetermined locations in the side walls of said vessel to receive and mix return water from the system and water bypassed from the work units prior to communicating this mixture to the supply inlet of the work units. The inlet ports are offset from the centerline of the vessel to cause entrained air to separate from the water streams and rise to exit the vessel through an air vent disposed in an upper portion of the vessel.

3 Claims, 2 Drawing Sheets

WATER HEATING AND COOLING SYSTEM HAVING A DUAL WATER MIXING AND AIR SEPARATOR APPARATUS

This application is a continuation of my application, Ser. No. 08/695,659, file Aug. 12, 1996, now U.S. Pat. No. 5,738,277.

TECHNICAL FIELD

The present invention relates generally to chiller and boiler water systems and particularly to an improved piping configuration utilizing an improved water mixing and air elimination vessel.

BACKGROUND ART

The piping configuration connecting evaporative chillers or boilers in a water cooling or heating system has long been the subject of controversy and problems in the industry. The problems are particularly significant in larger systems employing multiple chilling or boiler units connected in parallel in a variable volume system responsive to system demands.

In modern systems, safe operation of such heating or cooling units depends upon supplying a constant flow through the units. Therefore, these variable volume systems must have a bypass connecting the output of the heating and cooling units to the return water which is supplied to these units. A proper bypass connection ensures uniform water temperatures entering the heating or cooling units and permits a constant flow of water to the units so that reduction of the volume of return water supplied to the units does not occur. A reduction of return flow to the heating or cooling units often causes problems, such as spot freezing in the evaporators of a chilling unit for example. A proper bypass connection and maintaining a constant flow through the units allow the units to operate at the design tube velocity.

Further, uniform return water temperature supplied to the units prevents one or more of the units in a multiple unit system from operating at very low loads. For example, in a cooling system, low loads significantly increase energy consumption. Uniform loading of all the chiller evaporator units depends upon equal differential temperatures across of the units and minimizes energy consumption compared to non-uniform loading. To achieve uniform loading with no backflow of the return water through the bypass to the water leaving the chillers and directed to the system being cooled, a proper bypass configuration is required. Backflow of return water into the water supplied to the system causes significant efficiency problems which are very undesirable. This bypass also decouples the pressures between the chiller or boiler pumps and the cooling or heating system.

An appropriate remedy to avoid backflow of the return water through the bypass can be corrected by appropriate design. Such a design is disclosed in an article entitled Piping Chillers to Variable Volume Chilled Water Systems; ASHRAE Journal (July 1994) by James B. Rishel. The particular problems with an incorrect design are also discussed in this article.

However, the solution as described in this article has drawbacks because it requires a significant pipe length between the connection of the bypass to the output line from the boilers or chillers and the connection to the return line for the proper bypass arrangement to ensure that no backflow occurs. Due to space limitation in most equipment rooms designed for such systems, this piping design solution is often inconvenient or very difficult to achieve, particularly in systems requiring large pipe diameters.

A simple and more effective solution to such piping configurations requiring a bypass flow connection has eluded those skilled in the art for many years.

BRIEF DISCLOSURE OF INVENTION

The present invention relates generally to a piping connection configuration for chiller or boiler systems and particularly to an improved piping configuration for variable volume systems utilizing a novel bypass arrangement. In accordance with the present invention, a variable volume chilling or boiler system comprises the conventional chiller evaporators in a cooling system, or boilers in a heating system, which are connected by conventional piping in a closed loop such that cooled or heated water from the chiller units or heating units is circulated through the system ducts in one or more buildings and returned via a common conduit connected to the inlet of the chiller or heating units.

For purposes of brevity, chillers or boilers will be referred to herein as work units as the principles and concepts of the piping arrangement of the bypass connection applies in either case.

As well understood by those skilled in the art, primary and secondary pumps and conventional controls are utilized to control the flow of water directed through the system being cooled or heated within the capacity of the overall design.

In such systems wherein the volume or flow of water from the work units to the building system being cooled or heated varies with demand, water from the work units directed to the system should include a bypass connection between the supply to the building system and the return water from the building system which is directed back to the work units in order to maintain a constant inlet flow to the work units. It is also conventional to include an air separator tank in the return line. This latter device conventionally includes a cylindrical tank having an inlet to direct water tangentially against the tank walls to create a radial velocity and a zone at the center of the tank at a lower velocity. Air tends to rise toward the top of the tank and passes out of the top of the tank through a vented air valve to substantially reduce entrained air from the water leaving the tank at an outlet disposed near the lower end of the tank.

In accordance with the present invention an improved bypass configuration is provided by utilizing a modified air separator construction which includes a pair of inlets located at the same level or elevation in the tank and spaced at 90 degrees from one another and each disposed to create a tangential flow in the tank upon connection to the return water and the bypass flow respectively. Air entrained in either flow path tends to rise to the top of the tank and the water from each inlet is intimately mixed. This mixing ensures a more uniform water temperature of the return water directed to the work units as well as removing entrained air from the water supplied to the units.

As another aspect of this novel arrangement, the bypass path can be relatively short. In practice, a simple standard tee connection may be used to connect the outlet water from the work units to the bypass connection in the air separator/mixing tank with no concern of backflow of return water through the bypass path.

Therefore it is a primary object to provide an improved piping configuration for variable water chilling and heating systems utilizing a modified air separator and water mixing device which provide a simple and inexpensive bypass connection to the return water in a manner which prevents undesired backflow in the bypass, reduces space requirements and ensures both air separation and excellent mixing of bypass water and return water delivered to the work units.

DETAILED DESCRIPTION

Figure 1:
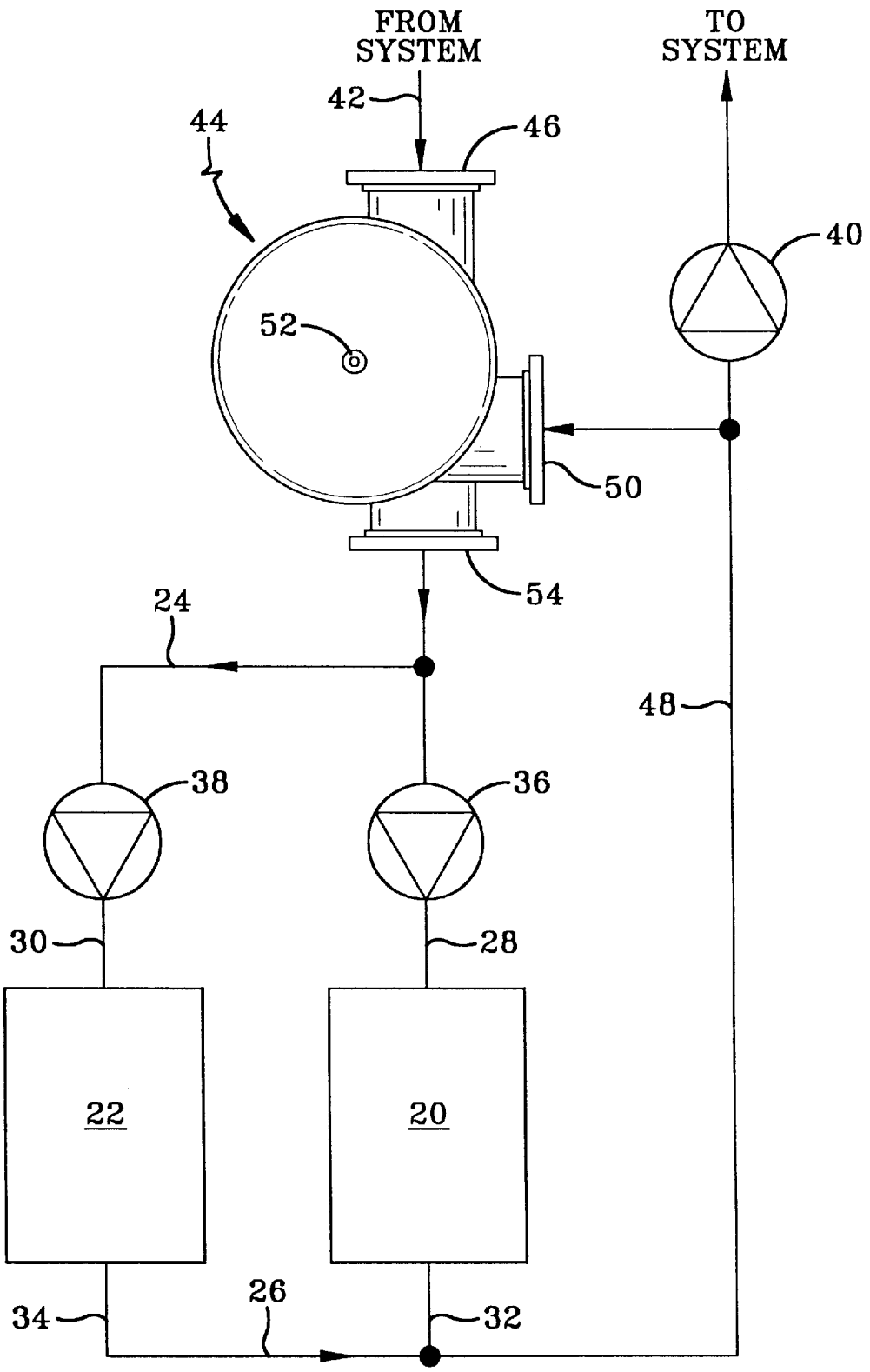
FIG. 1 is a diagrammatic view illustrating a simplified variable volume water heating or cooling system constructed in accordance to the present invention.
Figure 3:
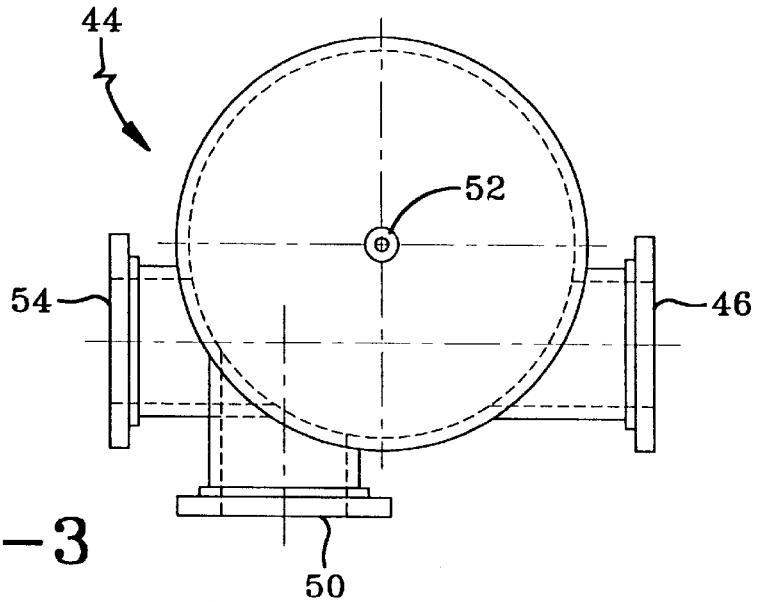
FIG. 3 is a top elevational view of the device shown in FIG. 2.
Figure 2:
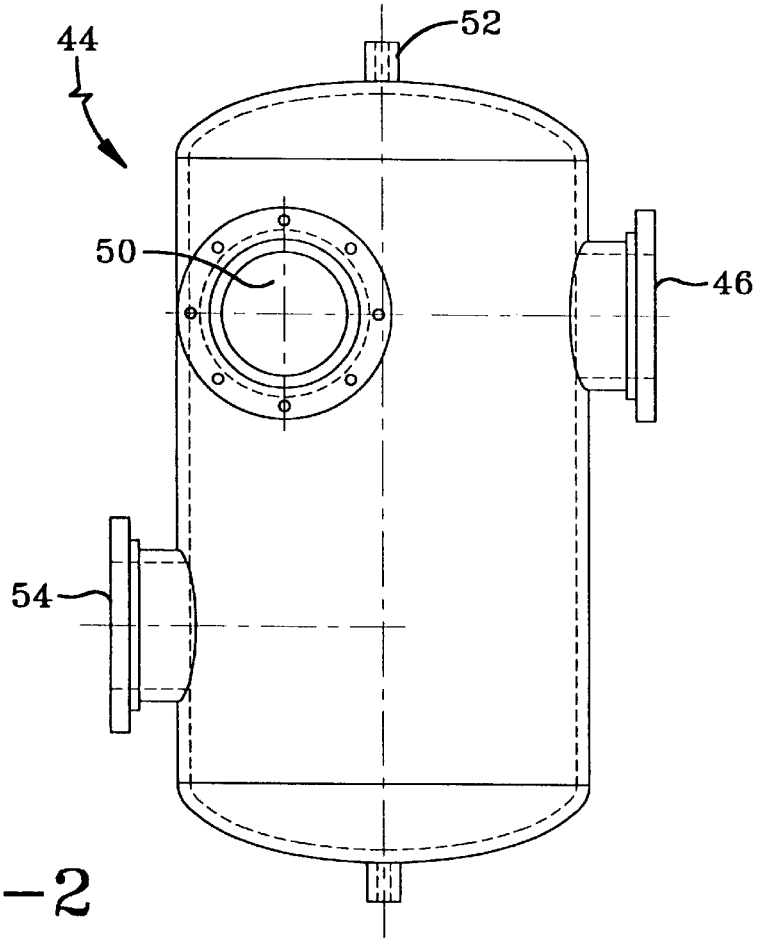
FIG. 2 is a front elevational view of an air separator/water mixing device constructed in accordance with the present invention and utilized to connect bypass water and return water directed to the work units.

A novel pipe connection configuration and an air separator/water mixing apparatus constructed in accordance with the present invention is illustrated in FIGS. 1–3. As diagrammatically illustrated in FIG. 1, a simplified chiller or boiler system is shown and includes work units 20 and 22 connected in parallel between a return line 24 and a system supply line 26 via connecting inlet lines 28 and 30 and outlet lines 32 and 34.

A pair of primary pumps 36 and 38 are operatively connected to return line 24 and work units inlet lines 28 and 30 in a conventional well-known manner. A secondary pump 40 is operatively connected to system supply line 26 to provide appropriate flow to the building system being cooled or heated in a conventional manner in accordance with conventional controls sensing the demand for heating or cooling the building.

The heated or cooled water leaving the work units is delivered to the building system and returned via line 42 in a closed loop to a water mixer and air separator vessel indicated generally at 44 through a first inlet port 46, shown in FIGS. 2 and 3. A bypass connection 48 from system supply lines 26 to air separator tank 44 is connected to vessel 44 via a second inlet port 50. Dependant upon the spacial configuration and the designer's choice, bypass connection 48 may include a standard pipe or conduit of any length or be a simple direct tee connection between line 26 and inlet port 50.

In the present invention the arrangement of the inlet ports 46 and 50 as described eliminate any requirement that the bypass connection between outlet lines 26 and return line 46 be separated by a pipe length equal to several pipe diameters as in prior art configurations used to prevent undesirable backflow of return water through the bypass. This advantage provides very significant savings of space in designing a new system or retrofitting an existing system given the limited space often provided in heating or cooling equipment plant rooms. In addition most building supply and return connections are adjacent to one another with very little space between them. The design of vessel 44 also allows a bypass connection between the supply and return lines without major modification of standard piping configurations.

Referring to FIGS. 2 and 3, water mixer and air elimination vessel 44 is provided with first and second inlet ports 46 and 50 suitably provided with conventional threaded, grooved or flanged couplings adapted to be conventionally connected to piping such as lines 46 and 48. Inlet ports 46 and 50 are preferably disposed 90 degrees from one another and offset from the centerline of vessel 44 such that the incoming flows of water are tangentially directed against the inner walls of vessel 44.

Therefore both the return water entering vessel 44 at inlet port 46 and any bypass flow entering vessel 44 via inlet port 50 are intimately mixed together via the tangential flow pattern and any entrained air in either incoming flow tends to separate and move toward the center of vessel 44 and then rises to exit through a conventional vented air valve 52 disposed in the top wall of vessel 44. The mixed water from inlets 46 and 50 exit through a common outlet port 54 located at a different elevation than inlets 46 and 50 and into line 24 leading to work units 20 and 22.

Vessel 44 is also provided with a removable drain plug 56 in a conventional manner in the bottom wall thereof. Conventional air separators employ a single inlet port offset from the centerline, however, no provision is made to accept a second inlet flow which may be connected to the bypass line from the output of the work units.

Locating the two inlet ports 46 and 50 at a different elevation than outlet port 54 and angularly displaced from one another in an offset position as described ensures adequate mixing of the incoming flows, removal of entrained air, and eliminates the potential of unintentional backflow of return water into line 42 through inlet port 50 and into the system supply line 26 in a simple and reliable manner. Adequate mixing of the incoming streams could also be achieved even if the inlet ports were disposed at a different elevation from one another in the side walls of vessel 44 as long as the outlet port is located at a higher or lower elevation relative to the inlet ports.

As noted in the ASHRAE article cited earlier herein, the velocity head of return water in line 42 is typically significantly greater than the velocity head directed to a bypass connection, therefore the likelihood that a backflow of return water through an improper bypass connection will occur to the detriment of the system is very significant.

The configuration of the present invention not only solves this problem, but does so in a manner which permits a more compact piping configuration and provides more intimate mixing of bypass water with return water to assure a more uniform temperature of the water entering the work units. In addition, entrained air is removed from both the return water and the bypass water in a single vessel.

However, it should also be understood that while the more preferred and more economically practical embodiment of the present invention includes a mixing vessel having the air vent as described to eliminate entrained air, the compact space saving configuration and the intimate mixing coupled with the positive elimination of unintentional backflow of return water through the bypass path is sufficiently advantageous to be used without the air separation feature and is within the spirit of the present invention.

In view of the foregoing description, one of ordinary skill in the art can appreciate the significant improvement provided by the present invention described herein in designing new systems as well as re-configuring an existing system.

I claim:

1. A closed loop variable volume water heating or cooling system of the type including one or more work units having outlets for supplying either cooled or heated water to a building system and having return water from said building system supplied to the inlet of said work units, the system comprising;

an air separator and water mixing vessel including;

a) a closed vessel including generally cylindrical side walls and a top and bottom wall;

b) a first water inlet port and a second water inlet port disposed in said side walls in circumferentially spaced relationship to one another and at a predetermined position intermediate the top and bottom walls of said vessel, said inlet ports being offset relative to the vertical center line of said vessel;

c) a water outlet port disposed in said side walls at a location selected from one closer to said top wall relative to the location of both said first and second inlet ports and one closer to said bottom wall relative to the location of both said first and second inlet ports;

d) a vented air valve disposed in said top wall to permit air separating from water streams entering said inlets to exit said vessel; and e) a first conduit communicating return water from said building system to said first water inlet port in said vessel, a second conduit forming a bypass communicating said outlet from said one or more work units to said second water inlet port of said vessel, and a third conduit communicating said water outlet port of said vessel to said inlet of said one or more work units.

2. In a close loop system having either heating or cooling work units supplying a variable volume of water at a predetermined temperature to control the temperature within a building, the combination of:

a) two or more of said work units, each having an outlet and an inlet, said outlets being communicated to a common building supply conduit and said inlets being communicated to a source of return water from said building, said work units being connected in parallel between said common building supply conduit and said source of return water;

b) a water mixing vessel disposed upstream from said inlets to said work units and including an enclosed vessel having generally cylindrical side walls and a top and bottom wall; first and second inlet ports disposed in said cylindrical side walls at an elevation intermediate the top and bottom walls and circumferentially spaced from one another, said inlet ports being disposed in an offset relationship to the vertical center line of said vessel, and a water outlet port disposed in said cylindrical side walls at a location selected from one closer to said top wall relative to the location of both said first and second inlet ports and one closer to said bottom wall relative to the location of both said first and second inlet ports;

c) a first conduit communicating return water from said building to said first inlet port of said vessel and a second conduit connected to said second inlet port and to said common building supply conduit forming a bypass path from said building supply conduit to said vessel, and a third conduit connected to said outlet port of said vessel and with said inlets of said work units to communicate a mixture of return water from said building and water bypassed from said building supply conduit to said inlets of said work units at a substantially uniform temperature and flow volume.

3. The system defined in claim 1 further including a vented air valve disposed in the top wall of said mixing vessel to allow entrained air separated from the water entering said vessel to exit said vessel.

* * * * *